US011853008B2

(12) United States Patent
Monferrer et al.

(10) Patent No.: US 11,853,008 B2
(45) Date of Patent: Dec. 26, 2023

(54) TIMEPIECE DISPLAY MECHANISM WITH AN INSTANTANEOUS JUMP FUNCTION

(71) Applicant: Blancpain SA, Le Brassus (CH)

(72) Inventors: Bernat Monferrer, St-Prex (CH); Lilian Joly, Sirod (FR)

(73) Assignee: Blancpain SA, Le Brassus (CH)

( * ) Notice: Subject to any disclaimer, the term of this patent is extended or adjusted under 35 U.S.C. 154(b) by 637 days.

(21) Appl. No.: 17/025,408

(22) Filed: Sep. 18, 2020

(65) Prior Publication Data

US 2021/0173344 A1 Jun. 10, 2021

(30) Foreign Application Priority Data

Dec. 5, 2019 (EP) ..... 19213804

(51) Int. Cl.

| | |
|---|---|
| ***G04B 19/24*** | (2006.01) |
| ***G04B 19/253*** | (2006.01) |
| ***G04B 19/04*** | (2006.01) |
| ***G04B 19/243*** | (2006.01) |

(52) U.S. Cl.

CPC ..... *G04B 19/25353* (2013.01); *G04B 19/042* (2013.01); *G04B 19/24313* (2013.01)

(58) Field of Classification Search

CPC ..... G04B 19/24313; G04B 19/042; G04B 19/25353; G04B 19/16

See application file for complete search history.

(56) References Cited

U.S. PATENT DOCUMENTS 4,240,249 A * 12/1980 Malkin ..... G04B 19/25373 368/37
8,199,612 B2 * 6/2012 Jolidon ..... G04B 19/16 368/231
9,256,207 B2 * 2/2016 Gruenig ..... G04B 19/247

(Continued)

FOREIGN PATENT DOCUMENTS

CH 3 366 A 10/1891
CN 106200344 A 12/2016

(Continued)

OTHER PUBLICATIONS

Translation of CH 3366—Jul. 29, 2023.*

(Continued)

*Primary Examiner* — Sean Kayes
(74) *Attorney, Agent, or Firm* — Oblon, McClelland, Maier & Neustadt, L.L.P.

(57) ABSTRACT

A timepiece display mechanism with an instantaneous jump function, including a Maltese cross mechanism with an annular ring controlling, in part of its travel, the pivoting of a planet wheel set and driven by a timepiece movement via a cam wheel set arranged to move the annular ring from an activated position to a deactivated position in an instantaneous displacement in order to pivot a planet wheel set, and vice versa in a controlled return slower than the instantaneous displacement, the cam wheel set includes a coaxial cam and plate including a slot for driving an eccentric finger of the cam which controls the pivoting of a driver driving the annular ring between two extreme activation and deactivation positions, the slot allowing a clear jump of the driver in the deactivation position, and a longer reactivation time.

20 Claims, 11 Drawing Sheets

(56) References Cited

U.S. PATENT DOCUMENTS

| | | | | |
|---|---|---|---|---|
| 10,067,473 | B2 * | 9/2018 | Carreno | G04B 19/046 |
| 10,222,751 | B2 * | 3/2019 | Robin | G04B 19/2536 |
| 11,449,006 | B2 * | 9/2022 | Leskerpit | G04B 47/044 |
| 2012/0127835 | A1 | 5/2012 | Dubugnon et al. | |
| 2017/0153602 | A1 | 6/2017 | Rudaz | |

FOREIGN PATENT DOCUMENTS

| | | | |
|---|---|---|---|
| CN | 106597831 | A | 4/2017 |
| CN | 110412855 | A | 11/2019 |
| EP | 2 428 856 | A1 | 3/2012 |
| EP | 2 428 856 | B1 | 3/2012 |
| EP | 2 359 198 | B1 | 1/2013 |
| EP | 3 173 878 | A1 | 5/2017 |
| WO | WO 2010/058367 | A1 | 5/2010 |

OTHER PUBLICATIONS

Google Search Maltese Cross—Jul. 29, 2023.*
European Search Report dated May 15, 2020 in European Application 19213804.8 filed Dec. 5, 2019 (with English Translation of Categories of Cited Documents), 3 pages.
Combined Chinese Office Action and Search Report dated Oct. 25, 2021 in Chinese Patent Application No. 202011405083.4 (with English translation of Category of Cited Documents), 5 pages.

* cited by examiner

TIMEPIECE DISPLAY MECHANISM WITH AN INSTANTANEOUS JUMP FUNCTION

FIELD OF THE INVENTION

The invention concerns a timepiece display mechanism with an instantaneous jump function, arranged to be driven by a timepiece movement, and comprising a stop work mechanism of the Maltese cross type with a control wheel set able to control, in part of its angular travel, the pivoting of at least one planet wheel set.

The invention also concerns a timepiece, particularly a watch, including at least one such display mechanism.

The invention concerns the field of display mechanisms for timepieces with complications.

BACKGROUND OF THE INVENTION

The use of Maltese cross stop work mechanisms is known for certain display functions in watchmaking. The best known is the leap year display on a perpetual calendar timepiece.

Usually, a Maltese cross mechanism is said to be a continuous drive mechanism. The planet wheel rotates continuously around a sun wheel, and the rotation of the planet wheel on its own axis is also slow and continuous.

Continuous displays create uncertainty for the user, especially around the time of the display change, because he does not have means of knowing whether or not the display change has taken place.

Patent No. WO2010/058367A1 in the name of BALLOUARD discloses a watch display mechanism, the movement of which drives a cannon-pinion, at the free end of which is attached an indicator member performing one revolution per hour above a dial provided with twelve or twenty-four markings indicating the hours in a circular arrangement. These markings are each connected to an isolated pinion, provided with an even number of teeth, driven simultaneously with one of its adjacent pinions by meshing with a toothed sector whose pitch diameter is equal to half the number of markings multiplied by the pitch diameter of the pinion, and which is rotated, around said cannon-pinion after each revolution of the indicator member, by an angular value equal to one revolution divided by the number of markings, by control means, which are driven in turn by the rotation of the cannon-pinion.

Swiss Patent No. CH3366A in the name of JACCARD discloses a watch, known as a 'handless watch' comprising a combination of a cannon-pinion carrying a cam and a wheel and a disc/finger designed to actuate a Maltese cross wheel. This disc carries one of the ends of a spiral spring, the other end of which is attached to the cannon-pinion or to the arbor carrying the latter, and a tooth or lower protuberance passing through an aperture in the wheel, in combination with a lever or arm having a tooth or protuberance and with a spring; the tooth or protuberance temporarily stopping the disc/finger during the continuous rotation of the cannon-pinion, and leaving it to its own devices as soon as the tooth or protuberance drops into the cam notch.

SUMMARY OF THE INVENTION

The invention proposes to make the jump of a Maltese cross mechanism instantaneous.

The invention also proposes to make a display mechanism for a timepiece, particularly a watch, implementing at least one planet wheel set having a specific movement. More particularly, this specific movement includes at least one phase of continuous rotational movement of the planet wheel set about an element called the sun wheel and at least one phase of isolated and instantaneous rotational movement of the planet wheel set on itself, at a precise place and time.

The invention consists in making the one-off rotation of the planet wheel about its axis instantaneous, while ensuring its rotation about the sun wheel, without changing the rotational speed of the planet axis around the sun wheel.

To this end, the invention concerns a timepiece display mechanism according to claim 1.

The invention also concerns a timepiece, particularly a watch, including at least one such display mechanism.

BRIEF DESCRIPTION OF THE DRAWINGS

Other features and advantages of the invention will appear upon reading the following detailed description, with reference to the annexed drawings, in which:

FIG. 9 represents the approach position of the planet wheel which is on the right of the Figure, and which is sliding in the clockwise direction, whereas the planet wheel visible on the left has just rotated and thus resumes a sliding travel; the annular ring is in the activated position;

FIG. 10 represents the pre-jump position; the planet wheel arrives in position at six o'clock; the annular ring is still in the activated position;

FIGS. 11 to 14 show a breakdown of the jump:

in FIG. 11, the planet wheel is still in position at six o'clock, the annular ring is currently rotating in the anticlockwise direction, it is in the process of changing from the activated position to the deactivated position;

in FIG. 12, the annular ring continues its anticlockwise travel and meshes with the planet wheel, and starts to rotate the latter;

in FIG. 13 this synchronised double movement continues;

in FIG. 14, the synchronised double movement is completed, the last tooth of the planet wheel leaves the outer toothing of the annular ring to present the truncated part of the planet wheel toothing opposite the cylindrical track of the annular ring;

in FIG. 15, in its post-jump position, the planet wheel has finished its instantaneous rotation of a half-turn on itself; the planet wheel, driven by the star, leaves the six o'clock position and will resume its sliding movement on the cylindrical track of the annular ring; the annular ring then returns from its deactivated position to its activated position, but this movement occurs more slowly than the advance of the star, so as not to interfere with the operation in progress with the planet wheel, but with the appropriate lag to be ready to cause the instantaneous jump of the next planet wheel, which will appear an hour later in the six o'clock rotation position in this particular and non-limiting embodiment;

DETAILED DESCRIPTION OF PREFERRED EMBODIMENTS

Figure 1:
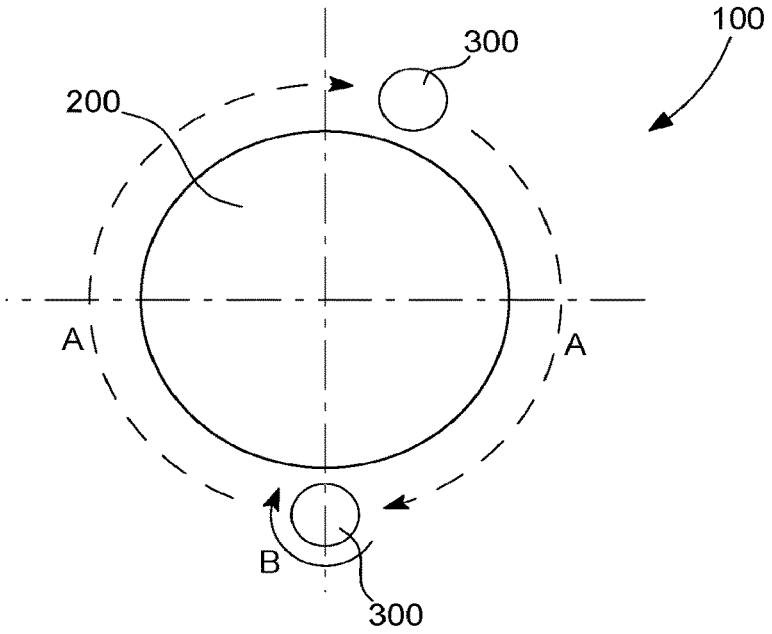
FIG. 1 schematically represents the specific movement of a planet wheel set about an element called the sun wheel; the planet wheel set is in continuous rotational movement (arrows A) about the sun wheel, and, in at least one angular position, performs a pivoting movement on itself (arrow B), this pivoting movement may be partial or total depending on the arrangement of the mechanism.
Figure 19:
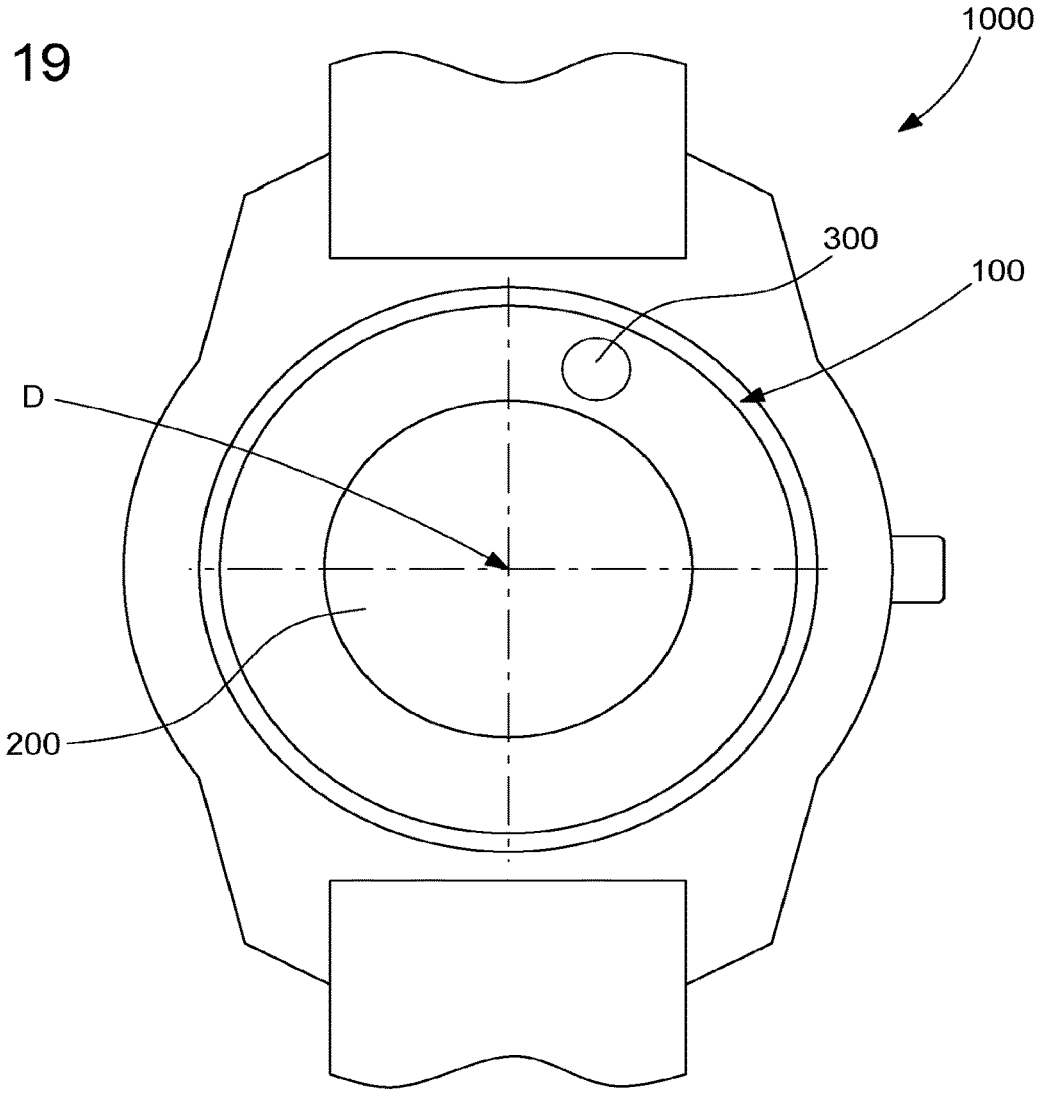
FIG. 19 represents a schematic plan view of a timepiece, consisting of a watch, comprising this display mechanism.

FIG. 1 sets out the general problem of the orbital movement of a planet wheel set about a fixed or movable element called the sun wheel, where the planet wheel set is in continuous rotational movement (arrows A) about the sun wheel, and, in at least one angular position, represented here in a non-limited manner at six o'clock, makes a pivoting movement on itself (arrow B), the angular travel of this pivoting movement depending on the arrangement of the mechanism.

The invention is illustrated here in a particular variant with a single point of rotation of the planet wheels, but it is understood that a particular display mechanism can comprise several such rotation points spread over the periphery of the sun wheel, depending on the desired display application.

The invention concerns a timepiece display mechanism 100 with an instantaneous jump function. This display mechanism 100 is arranged to be driven by a timepiece movement, and comprises a stop work mechanism of the 'Maltese cross' type with a control wheel set 200 able to control, in at least part of its angular travel, the pivoting of at least one planet wheel set 300.

According to the invention, this control wheel set 200 comprises a annular ring 10, which is arranged to be pivoted indirectly from a driver wheel set or a cannon-pinion 12 comprised in a timepiece movement, via a cam wheel set 456.

This cam wheel set 456 is arranged to move annular ring 10 from an activated position to a deactivated position by an instantaneous displacement of annular ring 10 in a first direction in order to pivot a planet wheel set 300 about a planet wheel axis, and to move annular ring 10 from the deactivated position to the activated position by a controlled displacement of annular ring 10, slower than the instantaneous displacement, in a return movement in a second direction, opposite to the first direction.

Cam wheel set 456 comprises at least one plate 15 and one cam 16 which are coaxially mounted. Plate 15 is driven indirectly by cannon-pinion 12, and comprises a slot 151, arranged to limit the travel of an eccentric finger 160 comprised in cam 16 and to drive said finger into a stop position at one end of the slot. The changing profile 161 of cam 16 controls the pivoting of a driver 17, which is arranged to drive annular ring 10 between two extreme activation and deactivation positions. On the one hand, slot 151 thus allows a clear jump of driver 17 which interacts with cam 16 in the deactivation direction, and on the other hand, a longer reactivation time related to the relative travel of finger 160 and of slot 151. The utility of the strip/finger system is that it makes possible an instantaneous drop of the feeler, which, when it falls, touches the smallest radius of the cam.

More particularly, control wheel set 200 comprises a first alternation of first sliding areas and first driving areas, and planet wheel set 300 comprises a second alternation of second clear areas and second driving areas. The second clear areas are each arranged to slide in turn over one of the first sliding areas of the control wheel set during part of the angular travel of control wheel set 200 corresponding to a rest position of planet wheel set 300. And the first driving areas of control wheel set 200 are arranged, in some portions of the angular travel of control wheel set 200, to cooperate with the second driving areas comprised in planet wheel set 300 to pivot planet wheel set 300 until a second clear area cooperates with a first sliding area in another rest position of planet wheel set 300.

More particularly, driver 17 is a pivoting rack, which is returned by a rack spring 18, and which comprises a rack toothing 170, which is arranged to cooperate with an inner annular ring toothing 107 of annular ring 10. This pivoting rack includes a feeler 171, which is arranged to follow the profile of cam 16.

More particularly, cam 16 is a snail cam with a changing external profile 161 in the shape of a snail and a front edge 162 allowing the jump. And the combination of slot 151 and finger 160 allows and limits the return of feeler 171 on the largest radius of cam 16.

In a particular embodiment, this changing snail-shaped external profile 161 expands over the first 180° of the cam, and is followed by a concentric portion with zero change over the rest of the angular travel; thus the toothed annular ring, in the activated position, can wait for the planet wheel to arrive. Preferably, the ascent ramp is not too steep, to avoid any interference with the planet wheel that has just jumped.

Advantageously, front edge 162 includes a slope that allows the mechanism to be reversible, which is useful during an adjustment, such as time-setting, which may require a backward movement.

According to the invention, cam wheel set 456 also comprises a friction wheel 14, which is mounted coaxially with plate 15 and cam 16, and is driven directly or indirectly (for example via a motion work wheel set 13) by cannon-pinion 12, and which is arranged to friction drive a pivot 152 of plate 15, and the angular adjustment of which with respect to the plate allows precise adjustment of the instant of jump of annular ring 10.

More particularly, annular ring 10 is annular and pivots, guided by annular ring rollers 19 that are eccentric with respect to its pivot axis. Guiding by rollers is, naturally, not exclusive, this is a particular and non-limiting case of a guidance system.

More particularly, display mechanism 100 comprises a star 4 carrying each planet wheel set 300, which is mounted to pivot in a continuous pivoting movement in a single direction of pivoting and driven by a wheel set of the timepiece movement. This continuous movement of the star is a particular, non-limiting case: it is understood that, for example, during a time-setting operation or suchlike, the rotation may not be continuous; the same is true for the direction of rotation, which may also be reversed, particularly in the same example of a time-setting operation.

Preferably, the pivot axes of annular ring 10 and of star 4 coincide; more particularly, they are coaxial with the main pivot axis D of hour wheel 1 or cannon-pinion 12 of the timepiece movement.

In a variant, each planet wheel set 300 is mounted to pivot freely on an arm 7 or the periphery of star 4.

In another variant, each planet wheel set 300 is mounted to pivot with friction in a housing comprised in an arm 7 or the periphery of star 4.

In particular, each planet wheel set 300, notably a planet wheel 8, is mounted at the end 71 of an arm 7, comprised in star 4, and which, in a particular variant, is flexible. This end 71 of arm 7 can also comprise a bearing for guiding another wheel set meshing with planet wheel 8. Planet wheel 8 can comprise a planet wheel hub 80, guided in a bore of end 71 of arm 7, or in a friction clamp comprised in end 71 of arm 7, formed by a complementary flexible arm 72. Planet wheel 8 can also include at least one flange 83 for axial limitation with respect to end 71 of arm 7.

In the particular variant illustrated by the Figures, each planet wheel set 300 includes a truncated toothing comprising teeth 81, 811, 812, 813, 814, 815, 816, which are arranged to cooperate with a toothed outer part 108 of annular ring 10, particularly annular ring teeth 1802, 1804, of annular ring 10 for the relative driving thereof. Annular ring 10 comprises recesses 1801, 1803, 1805 between its structure and teeth 1802 and 1804. And each planet wheel set 300 comprises recessed areas 82, 821, 822 which form second clear areas, allowing planet wheel set 300 to slide over a smooth cylindrical shoulder 9 comprised in annular ring 10. In the example illustrated by the Figures, the sliding occurs at teeth 811, 816 on the one hand, and 813, 814 on the other hand, of planet wheel set 300, which are collateral to each second clear area.

In the example illustrated by the Figures, planet wheel sets 300 each comprise two second clear areas 821, 822, which allow a 180° rotation of the planet wheel. It is evident that other embodiments are possible, for example three second recessed areas for a 120° rotation, or otherwise; likewise, these second recessed areas are not necessarily equidistant.

In another variant that is not illustrated, each planet wheel set 300 is a Maltese cross with arms each having a cylindrical hollow profile forming a second clear area, which is arranged to slide over a cylindrical shoulder 9 of annular ring 10. The branches of this Maltese cross are separated in a conventional manner by recesses, which are arranged to cooperate with a finger, or a tooth, or suchlike, protruding from annular ring 10 for the relative pivoting thereof.

In yet another variant, which is not illustrated, the mechanism comprises a Maltese cross which works on an inner toothing.

In a particular embodiment, display mechanism 100 is a moon phase or moon age display.

In another particular variant, display mechanism 100 is a day/night display.

In another particular variant, display mechanism 100 is an AM/PM display. In another particular variant, display mechanism 100 is a universal time display.

In another particular variant, display mechanism 100 is a calendar, date, day or month or leap year display.

The invention also concerns a timepiece 1000 comprising a timepiece movement, which is arranged to drive at least one such display mechanism 100.

According to the invention, this display mechanism 100 comprises a separate function for driving control wheel set 200 in a back-and-forth pivoting movement with a limited angular travel, and for the continuous pivoting in a single direction of a star 4 carrying each planet wheel set 300.

More particularly, this timepiece 1000 is a watch.

The Figures illustrate a particular, non-limiting variant of the invention and detail its operation.

Display mechanism 100 is composed here of two subsystems, which are combined with each other:

- a first mechanism concerns the driving of star 4, which carries planet wheel 300, or planet wheels 3000 in the present case: this mechanism is arranged to take information from the train of a mechanical or electromechanical timepiece movement, to achieve a reduction in rotational speed via gear train, transmission and rotational guidance;
- a second mechanism concerns the driving of annular ring 10, which carries the fixed Maltese cross tooth; this mechanism is arranged to take information from the train of a mechanical or electromechanical movement, to allow adjustment by using a friction system, to produce a jump through the use of a cam mechanism, transmission and rotational guidance.

Figure 2:
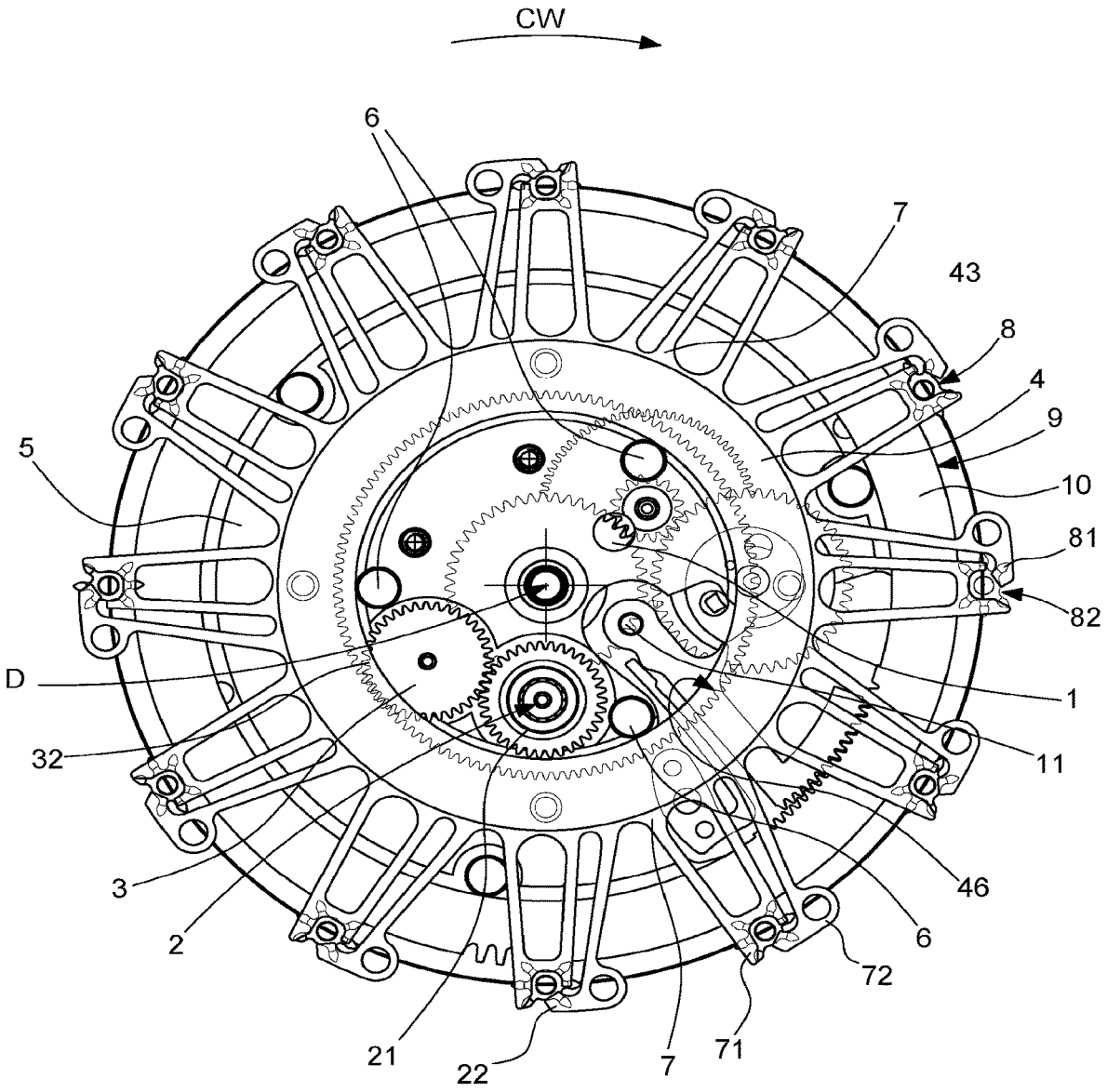
FIG. 2 shows a schematic, partial and plan view of one portion of an instantaneous jump display mechanism according to the invention, showing only the constituent elements of a drive mechanism, from a gear train of a timepiece movement, of a star whose arms carry these planet wheel sets, consisting here of planet wheels, each comprising a partially truncated toothing, and each arranged to slide over a cylindrical portion of an annular ring guided on annular ringannular ring rollers, or to mesh with an outer toothed portion of this annular annular ringring, depending on the angular position of the planet wheel concerned; this star rotates continuously here, in a non-limiting manner, on star rollers, and rotates here in the clockwise direction.
Figure 3A:
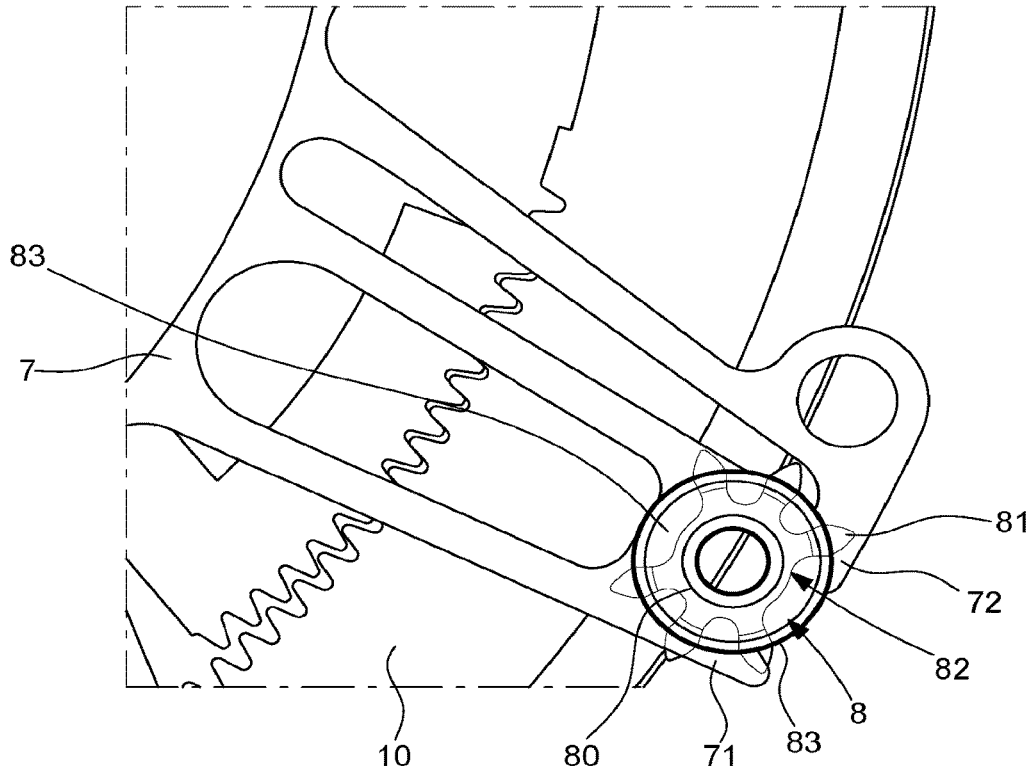
FIG. 3*a* is a plan view of a detail of FIG. 2 showing such a planet wheel in its sliding position on the cylindrical portion of the annular ringannular ring.
Figure 3B:
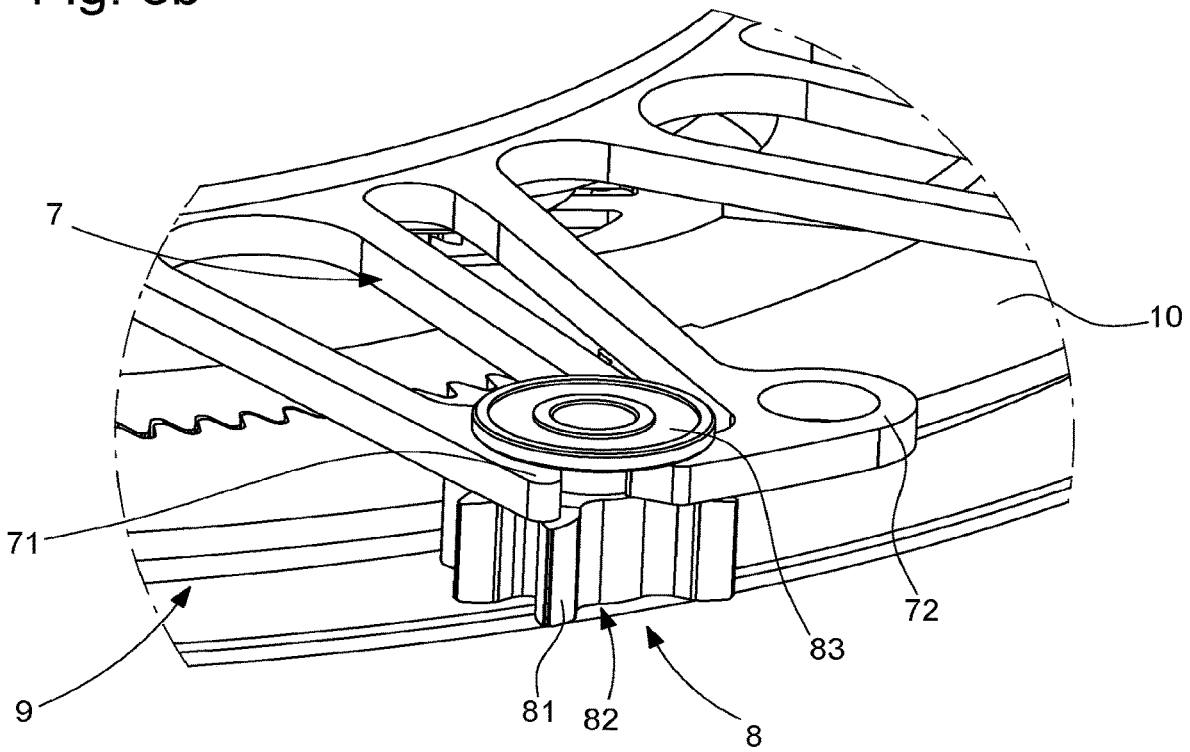
FIG. 3*b* represents the same detail in perspective.

The sub-system relating to the driving of star 4, illustrated in FIG. 2, has the objective of rotating planet wheel sets 300, here planet wheels 8, at constant speed around a plate 5.

To achieve this movement, the information is taken at the centre of a timepiece movement, in particular but not exclusively from an hour wheel 1 comprising a toothing 11, this information is transmitted by a gear train, comprising, in particular, a gear reduction wheel set 2 with toothings 21 and 22 and an intermediate wheel 3, to star 4, via its inner toothing 43. Star 4 pivots around plate 5 by means of star rollers 6 guiding a bore 46 of star 4 and makes one revolution in twelve hours in the clockwise direction in the particular case illustrated. Naturally, this revolution in twelve hours is a particular design illustrated by the Figures, and other time values can be chosen for other applications, without departing from the invention. More particularly, star 4 comprises an inner toothing 43 on an annular rim which pivots, guided by star rollers 6 that are eccentric with respect to the pivot axis of star 4. Guidance by rollers is only a particular case illustrated by the Figures, other modes of guidance can be envisaged, such as rotary bearing guidance, or otherwise. This toothing 43 cooperates with toothing 32 of intermediate drive wheel 3.

Star 4 has twelve arms 7 here, these are more particularly but not exclusively flexible arms, these arms 7 make it possible to form a pivot with each planet wheel 8. Planet wheels 8 are driven in rotation around plate 5 by star 4, and they are angularly guided most of the time by annular ring 10, by the toothing of planet wheels 8 sliding against cylindrical outer surface 9 of annular ring 10.

Each planet wheel 8 makes one complete rotation around plate 5 in twelve hours, but without rotating on itself.

The sub-system relating to the driving of annular ring 10 has the objective of managing the displacement and angular position of annular ring 10.

Annular ring 10 moves from the activated to deactivated position in a rapid instantaneous movement and then returns to the activated position in a slow controlled movement. More particularly, the rise during return to the activated position changes at the beginning and is zero at the end.

To achieve these various movements of annular ring 10, the information is, particularly but not exclusively, taken at the centre of the timepiece movement from a cannon-pinion 12 and is transmitted by a motion work wheel set 13 to a cam wheel set 456. This cam wheel set 456 includes a friction wheel 14, which thus has a constant rotational speed, and makes one revolution in an hour in the clockwise direction (in the Figures CW=clockwise).

Cam wheel set 456 has three stages: friction wheel 14, a plate 15 and a cam 16 which carries an eccentric finger 160. This cam 16 has the function of manoeuvring a driver, here a pivoting rack 17, to move annular ring 10 in one or other direction. Friction wheel 14 drives plate 15 via the friction exerted, for example, on a tapered shoulder 152 of plate 15 by flexible strips comprised in friction wheel 14 which delimit a slot 140. Plate 15 drives finger 160 of cam 16 via a slot 151 comprised in plate 5, particularly a slot in the arc of a circle concentric to plate 15.

The friction allows precise adjustment of the instant of jump of annular ring 10, and slot 151 allows a clear jump of rack 17 which interacts with cam 16.

Rack 17, constrained by a rack spring 18, takes the information from the periphery of cam 16, and transmits it to annular ring 10 by the meshing of inner toothing 107 of annular ring 10 with rack toothing 170. More particularly, annular ring 10 pivots about plate 5 by means of annular ring rollers 19 which guide a annular ring bore 119.

Annular ring 10 thus makes an instantaneous jump from its activated position to its deactivated position (in the Figures ACW: anti-clockwise), and then slowly returns in the opposite direction (in the Figures CW: clockwise) to the activated position, and this cycle is periodically repeated, for example every hour in the mechanism illustrated by the Figures; naturally this periodicity depends on the type of display, and the period would be different for a moon age display, for example.

Figure 4:
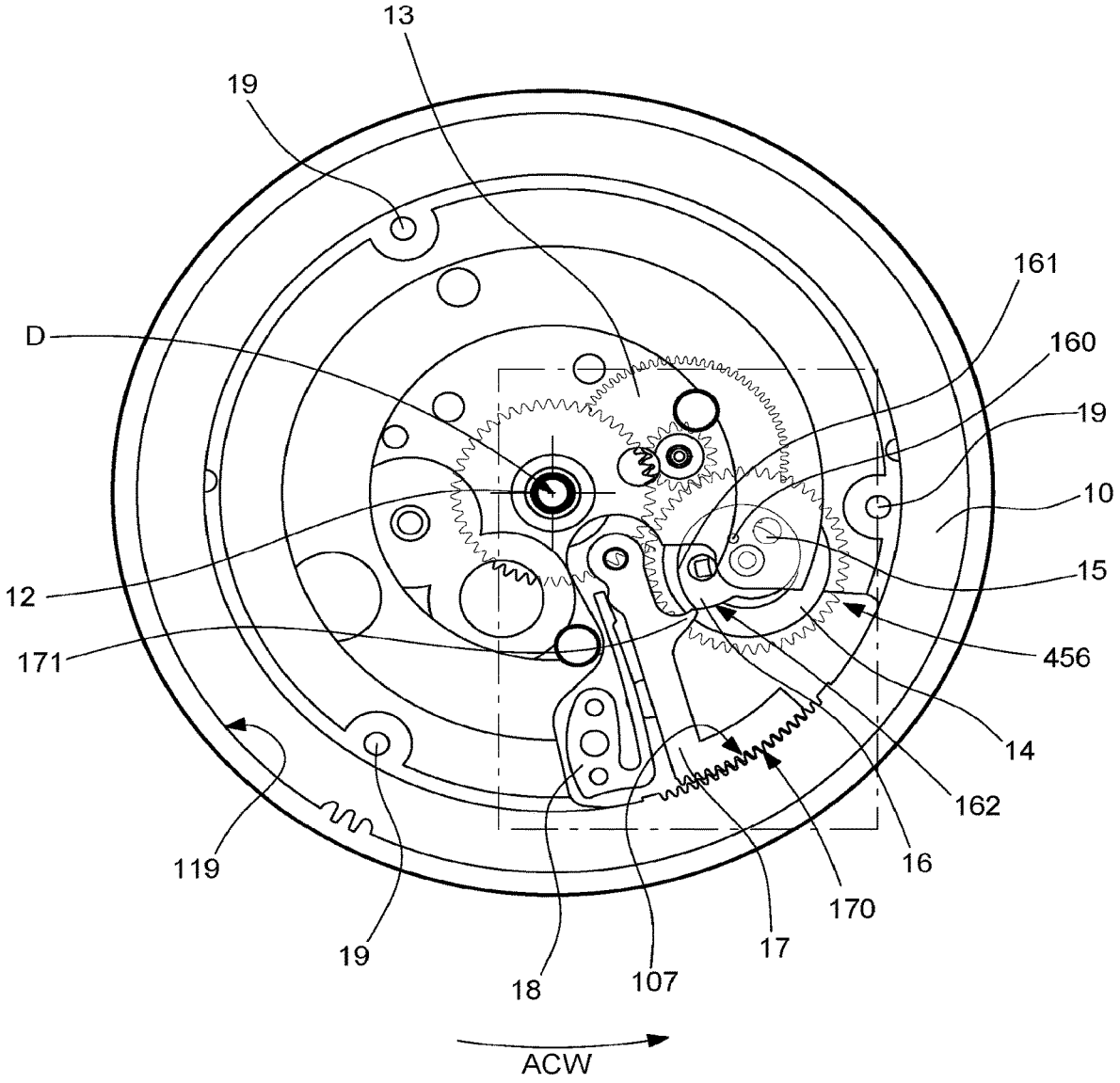
FIG. 4 represents, in a similar manner to FIG. 2, another portion of the same instantaneous jump display mechanism according to the invention, in which only the constituent elements of a drive mechanism are shown, from a gear train of a timepiece movement and through a cam wheel set and then a driver, of the annular ringannular ring with which the planet wheels cooperate, this drive mechanism being represented in an activated position of the annular ringannular ring, the arrow indicates the anti-clockwise direction in which the annular ring will pivot as soon as a feeler of this driver, which follows a snail cam of this cam wheel set, falls, this pivoting movement driving in rotation the planet wheel which then appears opposite the outer toothed portion of the annular ring.
Figure 5:
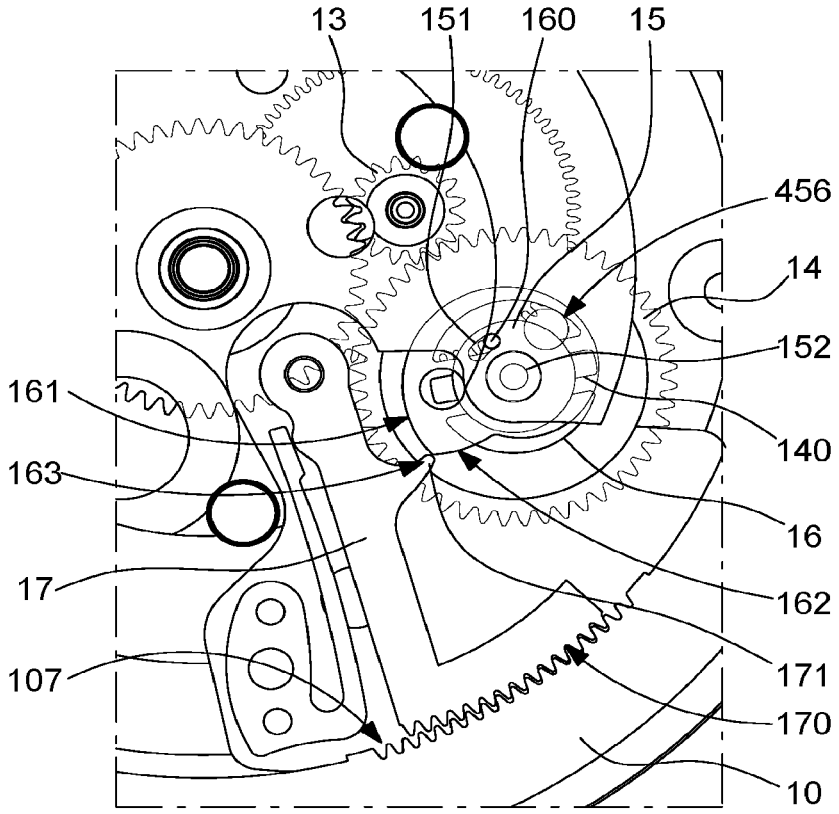
FIG. 5 is a detail of FIG. 4, showing the cam wheel set which includes, coaxial and superposed on each other: a friction wheel, a plate, and a snail cam, the friction wheel adjustably driving the plate which includes a slot for limiting and driving an eccentric finger comprised in the snail cam, on which moves the driver feeler, which is a pivoting rack here, comprising a rack toothing arranged to cooperate with a annular ring toothing.
Figure 7:
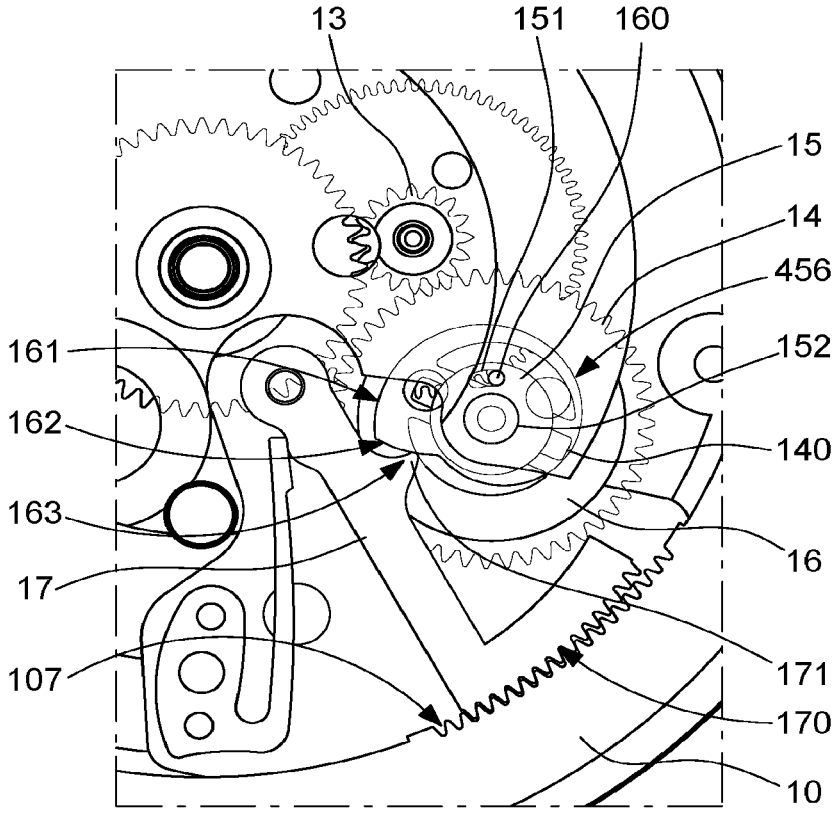
FIG. 7 is, in a similar manner to FIG. 5, a detail of FIG. 6.

FIG. 4 shows the annular ring drive system in the activated position, rack 17 comprises a feeler 171 which is resting on a beak comprised in cam 16 on its largest radius, at the boundary between a snail 161 and a front edge 162, particularly a substantially straight front edge, intended to cause the jump.

Figure 6:
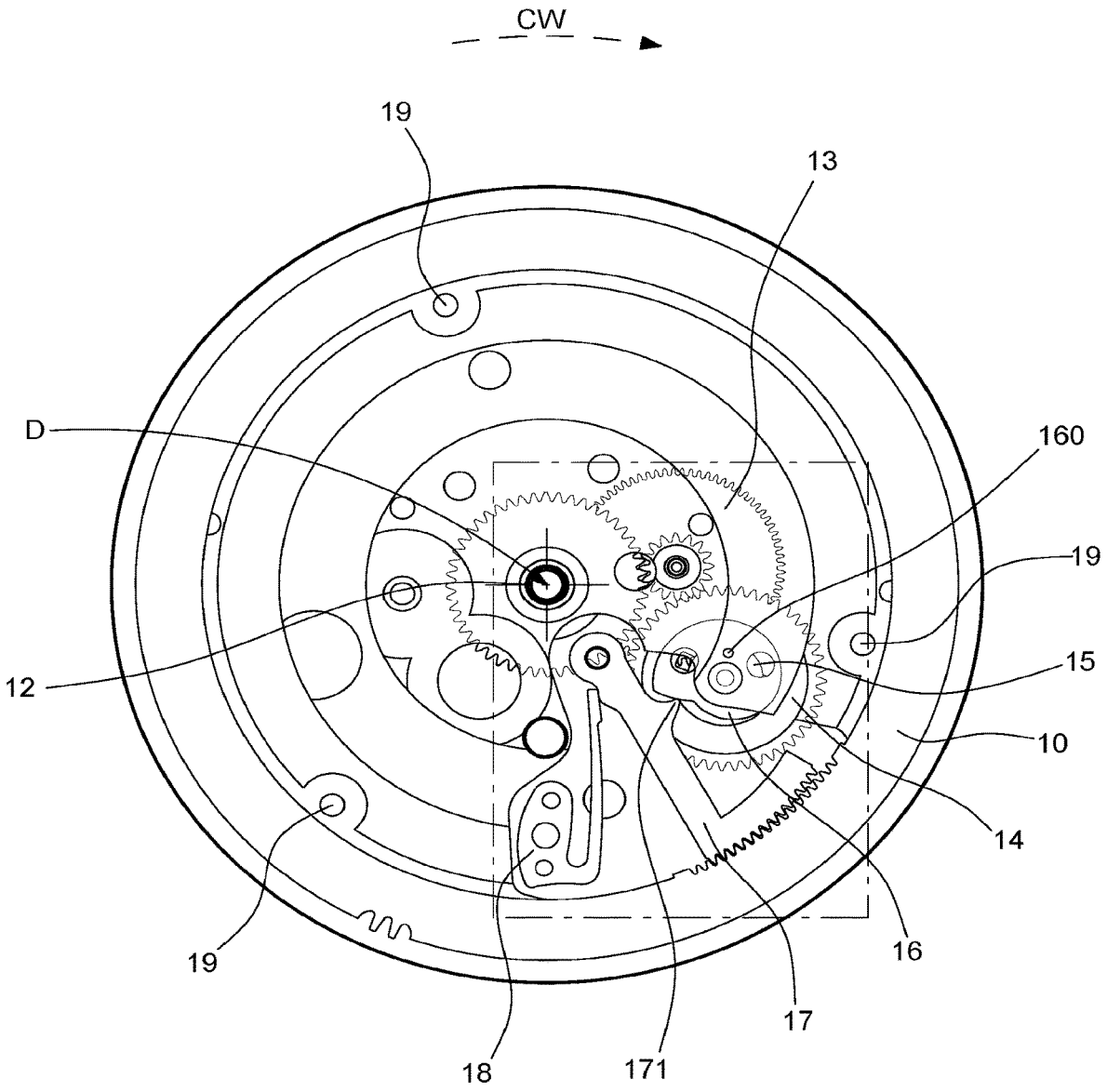
FIG. 6 represents, in a similar manner to FIG. 4, the same drive mechanism represented in the deactivated position of the annular ring: the arrow indicates the clockwise direction, in which the annular ring is ready to pivot subsequently, relative to the instant illustrated in FIG. 6, in the anticlockwise direction, when the same feeler rises to the highest point of the snail cam

FIG. 6 shows the annular ring drive system in the deactivated position; feeler 171 is resting on the smallest radius of snail 161, just after having crossed front edge 162.

Figure 8:
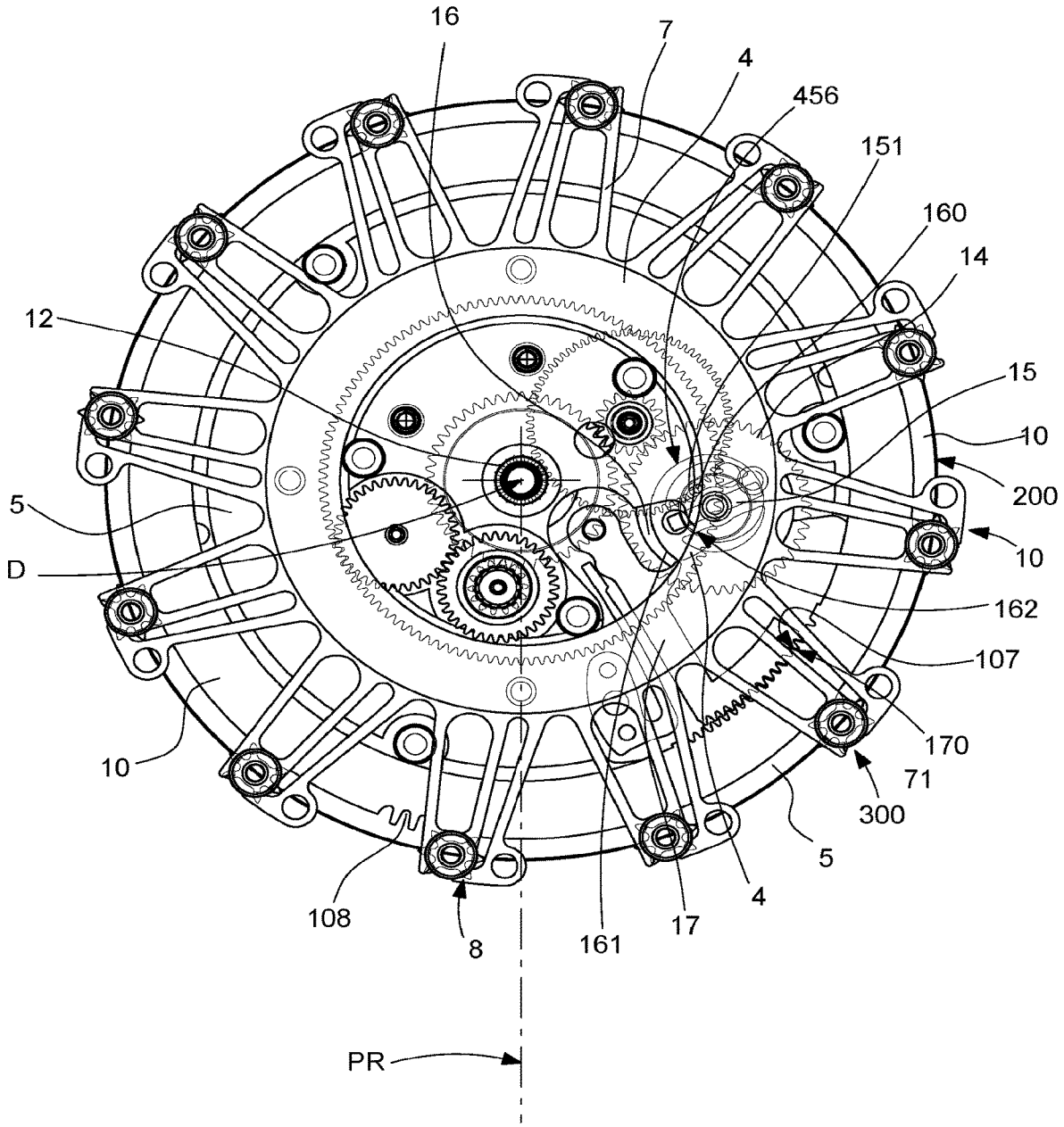
FIG. 8 represents a schematic, partial plan view of the entire instantaneous jump display mechanism, in which the star drive mechanism and the annular ring drive mechanism are combined, to ensure both the orbital movement of the planet wheels with respect to a plate of the movement, and the instantaneous rotational movement of each planet wheel when it appears opposite the outer toothed portion of the annular ring and just before the instant when this annular ring moves in an instantaneous jump from its activated position to its deactivated position.

FIG. 8 illustrates the entire Maltese cross mechanism with an instantaneous jump function according to the invention, which combines the two sub-systems mentioned above. Planet wheels 8 are driven by arms 7 of star 4 and rotate at constant speed about plate 5. When a planet wheel 8 reaches the six o'clock position, annular ring 10 causes it to make an instantaneous half-turn on itself. As a reminder, planet wheel 8 is constantly rotated about plate 5 by star 4, and it is angularly guided by plate 5.

Figure 9:
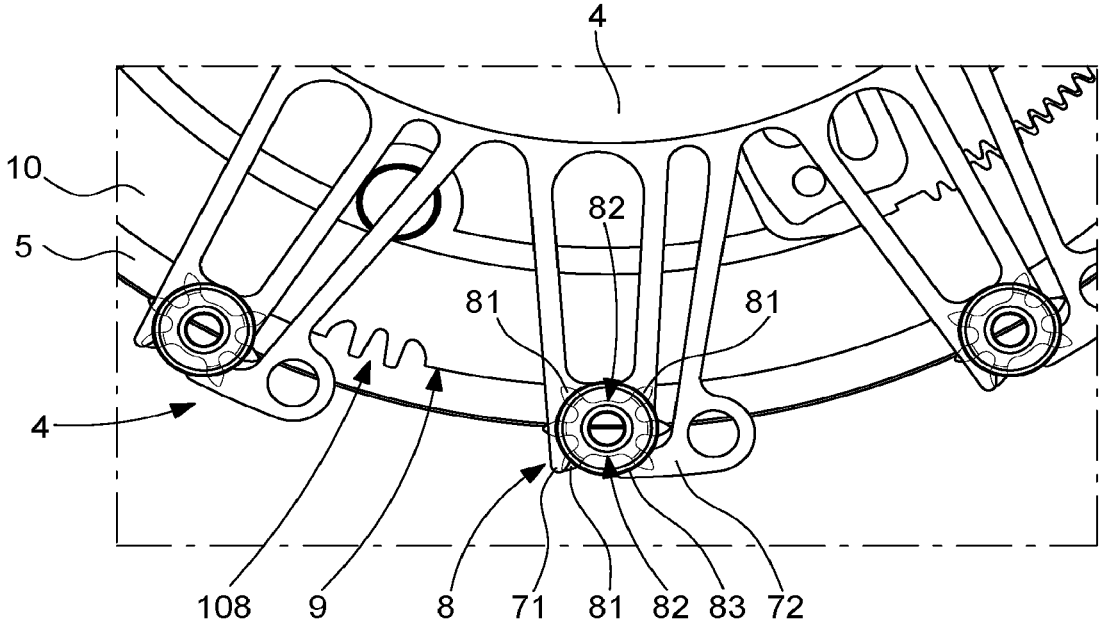
FIGS. 9 to 15 represent, in a similar manner to FIG. 3, the successive steps of the kinematics of a planet wheel.
Figure 10:
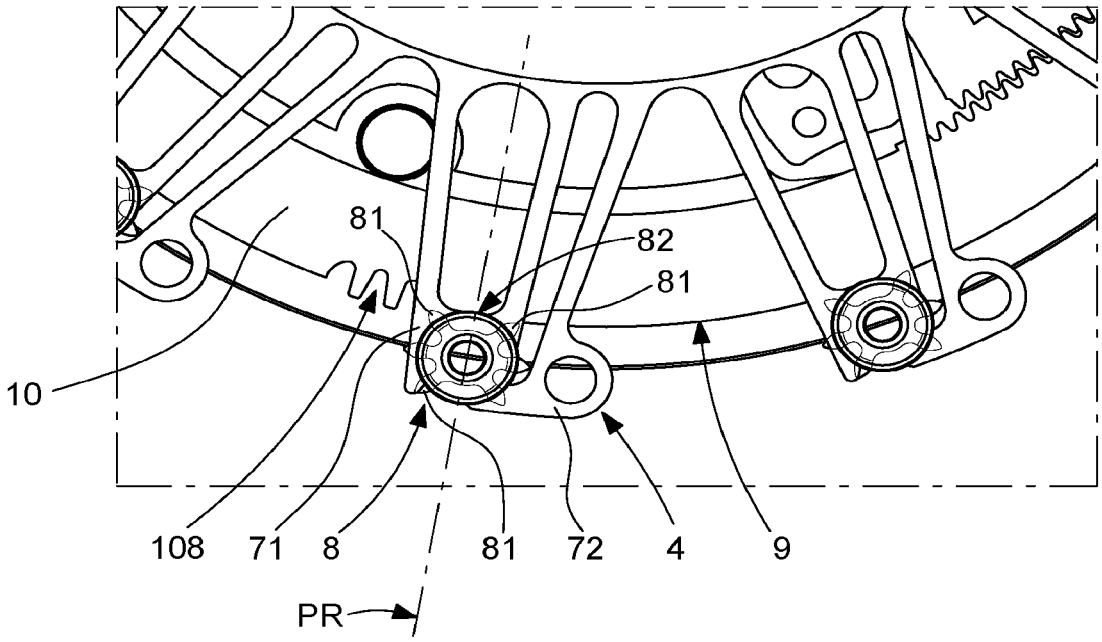
Figure 11:
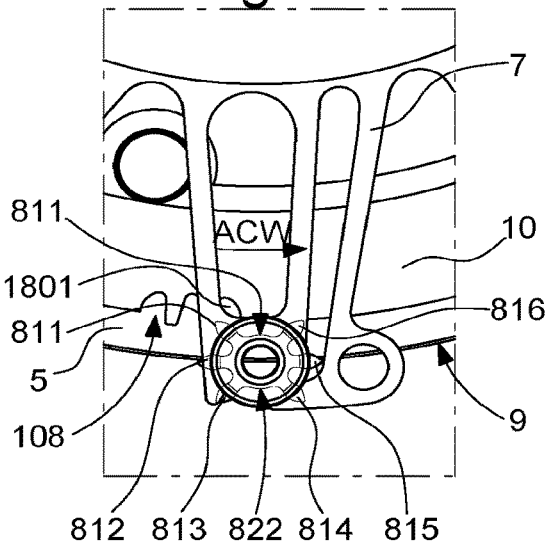
Figure 12:
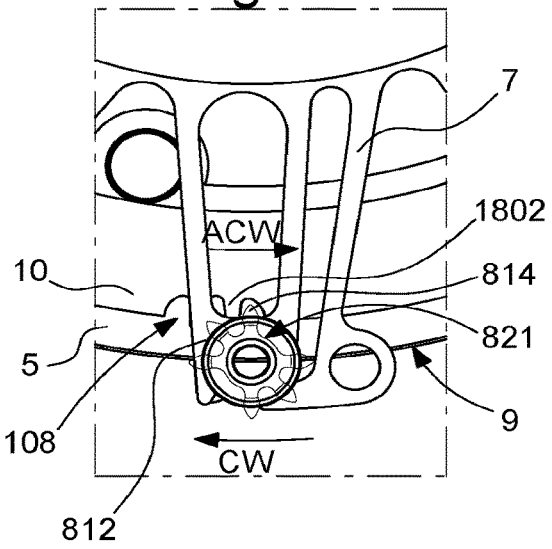
Figure 13:
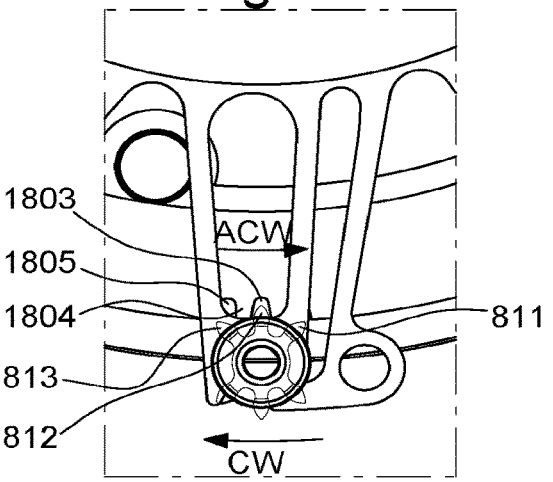
Figure 14:
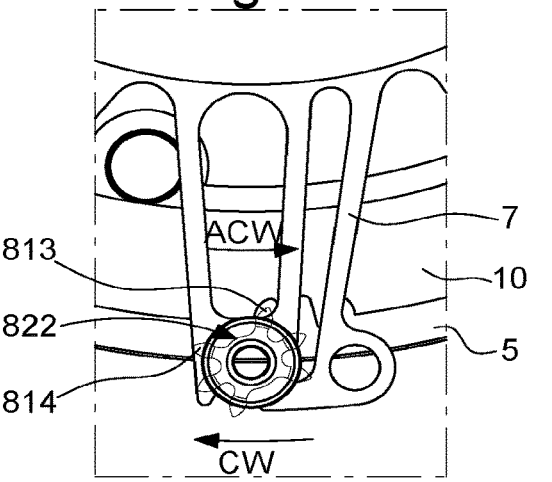
Figure 15:
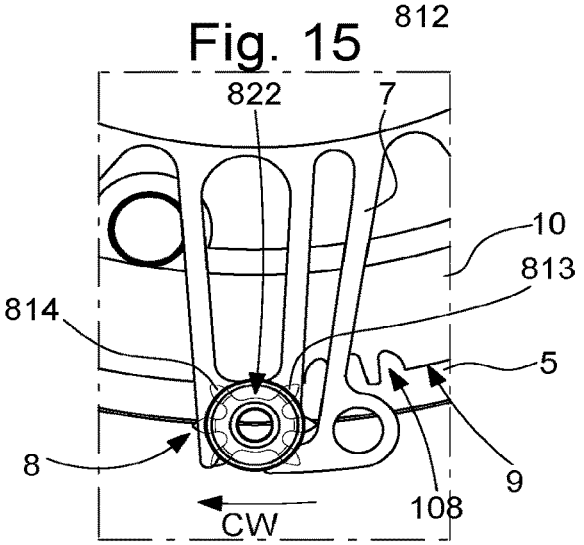
Figure 16:
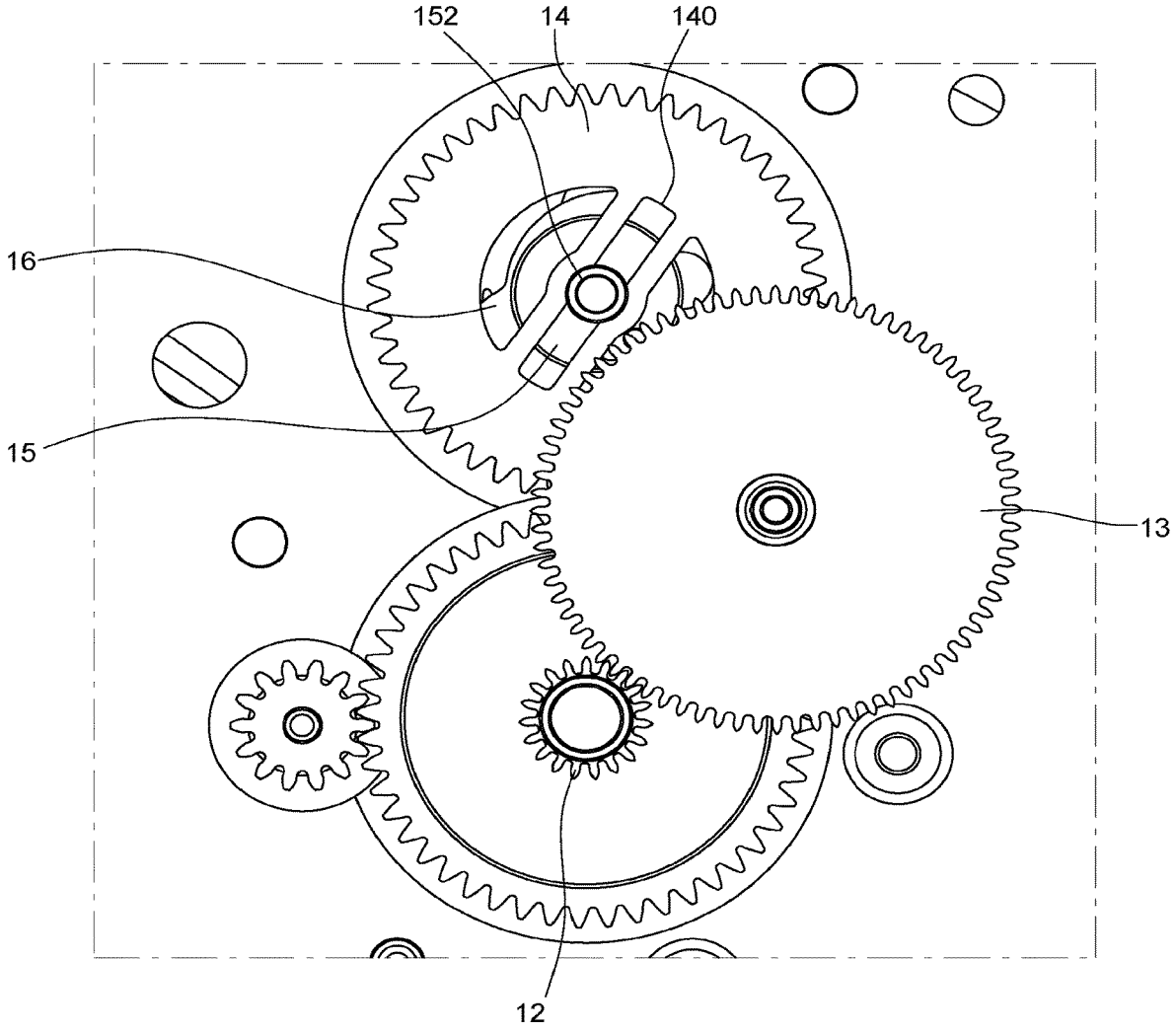
FIG. 16 represents a schematic plan view, seen from the opposite side of the movement to that of all the preceding Figures, of the cam wheel set which includes a friction wheel which is driven, via a motion work wheel set, by the cannon-pinion, and which friction drives a pivot of the plate, and is mounted coaxial with the plate and the cam, and the angular adjustment of which with respect to the plate allows precise adjustment of the instant of jump of the annular ring.
Figure 17:
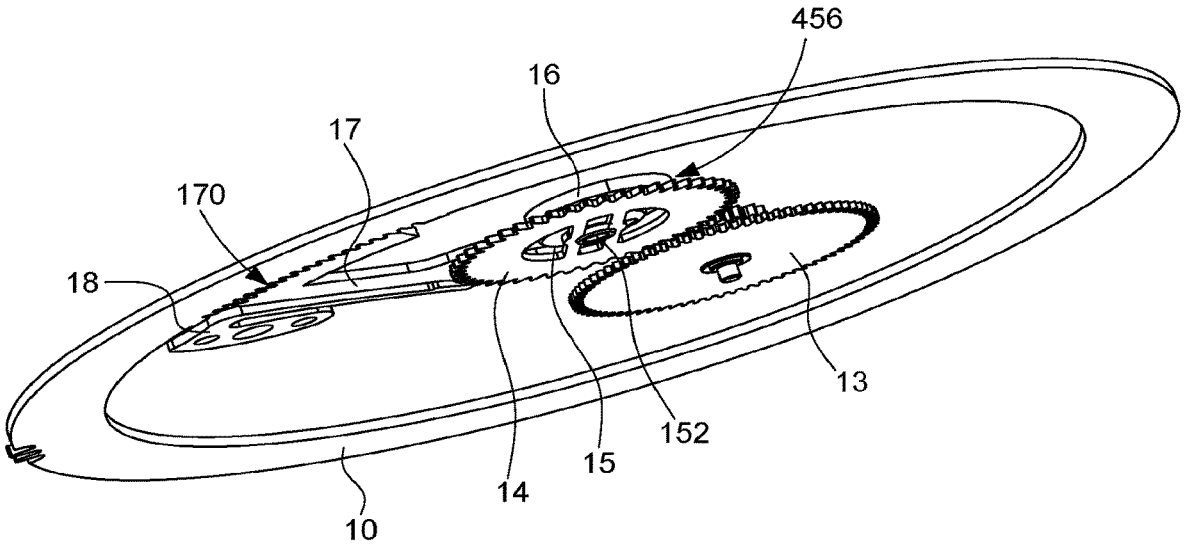
FIG. 17 represents a perspective view of the cam wheel set from the same side.
Figure 18:
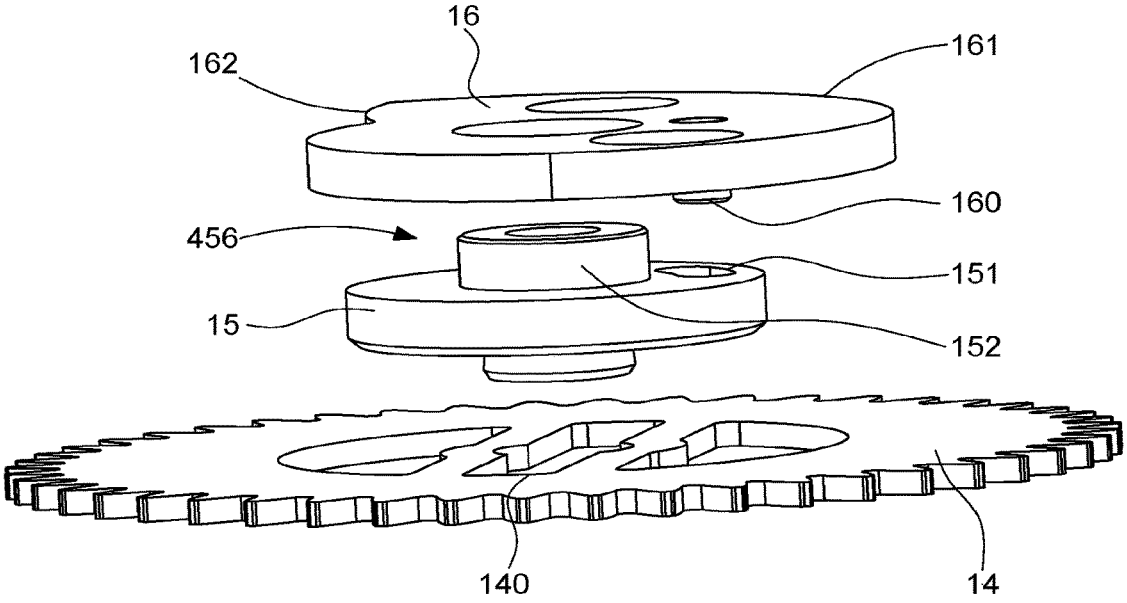
FIG. 18 represents an exploded perspective view of the cam wheel set from the same side.

The sequences of the instantaneous jump of planet wheels 8 are as follows:

- approach position, as seen in FIG. 9: planet wheel 8 is driven by star 4, and is guided as it slides by annular ring 10, which is in the activated position;
- pre-jump position, as seen in FIG. 10: planet wheel 8 is in the six o'clock position of a timepiece, particularly a watch, this particular position being non-limiting; annular ring 10 guides planet wheel 8; annular ring 10 is still in the activated position;
- jump, broken down in FIGS. 11 to 14, which show the permutation of recesses 821 and 822 during the half-turn manoeuvre, and in that order; planet wheel 8 is still in the six o'clock position, annular ring 10 is now rotating, it moves from the activated position to the deactivated position, and, during its travel meshes with planet wheel 8 to impart a half-turn thereto; planet wheel 8 has instantaneously made a half-turn on itself; tooth 811 has moved into first recess 1801 of annular ring 10, then second tooth 812 into second recess 1803 after first annular ring tooth 1802, then third tooth 813 into third recess 1805 after second annular ring tooth 1804, allowing second wheel set recess 822 to move gradually towards cylindrical shoulder 9, i.e. the lateral sides of teeth 813 and 814 slide over shoulder 9;
- post-jump position, as seen in FIG. 15: planet wheel 8 is guided by annular ring 10 and, driven by star 4, it leaves the six o'clock position and is guided by its teeth 813 and 814, which flank its second recess 822, on cylindrical shoulder 9 of annular ring 10. Annular ring 10 then returns from its deactivated position to its activated position, but this movement is made more slowly than the advance of star 4, in order not to interfere with the operation in progress with planet wheel, 8 but with the appropriate lag to be ready to make the next planet wheel, which will appear an hour later, jump instantaneously.

The invention offers significant advantages. It makes it possible, in particular, for a Maltese cross mechanism to make an instantaneous jump. Achieving such an instantaneous jump directly impacts the display and ensures reading reliability for the user. The indicator moves from one position to another in a clear manner, without an intermediate position; for example, the AM/PM change at twelve o'clock. Thus, the user sees information that can be read clearly, precisely and unambiguously.

The mechanism according to the invention tolerates a backward adjustment, for example during a time-setting operation or similar, with a defect in synchronization at the instant of the jump.

The invention claimed is:

1. A timepiece display mechanism with an instantaneous jump function, arranged to be driven by a timepiece movement, and comprising a stop work mechanism of a Maltese cross type with a control wheel set configured to control, in part of an angular travel of the stop work mechanism, a pivoting of at least one planet wheel set wherein said control wheel set comprises an annular ring arranged to be pivoted indirectly from a driver wheel set or a cannon-pinion comprised in said timepiece movement, via a cam wheel set, said cam wheel set is arranged to move said annular ring from an activated position to a deactivated position by an instantaneous displacement of said annular ring in a first direction in order to pivot said planet wheel set about a planet wheel axis, and to move said annular ring from said deactivated position to said activated position by a controlled displacement of said annular ring, slower than said instantaneous displacement, during a return movement in a second direction, opposite to said first direction, and wherein said cam wheel set comprises a plate and a cam, which are coaxially mounted, said plate being indirectly driven by said cannon-pinion and comprising a slot for driving an eccentric finger of said cam a profile of which controls a pivoting of a driver arranged to drive said annular ring between two extreme activation and deactivation positions, said slot allowing, on the one hand, a clear jump of said driver which interacts with said cam in the deactivation direction, and on the other hand, a longer reactivation time related to the relative travel of said finger and of said slot, and said cam wheel set also comprises a friction wheel, mounted coaxially with said plate and said cam, and driven directly or indirectly by said cannon-pinion, and arranged to friction drive said plate, and an angular adjustment of which with respect to said plate allows precise adjustment of the instant of jump of said annular ring.

2. The display mechanism according to claim 1, wherein said control wheel set further comprises a first alternation of first sliding areas and first driving areas, said planet wheel set comprises a second alternation of second clear areas and second driving areas, said second clear areas each being arranged to slide in turn over one of said first sliding areas of said control wheel set during part of the angular travel of said control wheel set corresponding to a rest position of said planet wheel set and said first driving areas of said control wheel set are arranged, in some portions of the angular travel of said control wheel set to cooperate with said second driving areas comprised in said planet wheel set to pivot said planet wheel set until one said second clear area cooperates again with a said first sliding area in another rest position of said planet wheel set.

3. The display mechanism according to claim 2, wherein each said planet wheel set has a truncated toothing comprising teeth arranged to cooperate with annular ring teeth comprised in said annular ring for the relative driving thereof, and recessed areas forming said second clear areas and arranged to slide over a cylindrical shoulder comprised in said annular ring.

4. The display mechanism according to claim 2, wherein each said planet wheel set is a Maltese cross with branches each having a hollow cylindrical profile forming a second clear area arranged to slide over a cylindrical shoulder comprised in said annular ring, said branches being separated by recesses arranged to cooperate with a protruding finger of said annular ring to cause the relative pivoting thereof.

5. The display mechanism according to claim 1, wherein said driver is a pivoting rack returned by a rack spring and comprising a rack toothing arranged to cooperate with an inner annular ring toothing comprised in said annular ring, and comprising a feeler arranged to follow the profile of said cam.

6. The display mechanism according to claim 5, wherein said cam is a snail cam with a changing external profile and a front edge allowing the jump.

7. The display mechanism according to claim 6, wherein a combination of said slot and said finger allows to obtain an instantaneous drop of said feeler.

8. The display mechanism according to claim 1, wherein said annular ring is annular and pivots guided by annular ring rollers that are eccentric with respect to a pivot axis of the annular ring.

9. The display mechanism according to claim 1, wherein said display mechanism comprises a star carrying each said planet wheel set, and mounted to pivot coaxially to said annular ring, in a continuous pivoting movement in a single direction of pivoting, driven by a wheel set of said timepiece movement.

10. The display mechanism according to claim 9, wherein said star comprises an inner toothing on an annular rim, which comprises a pivot bearing, or which pivots guided by star rollers that are eccentric with respect to a pivot axis of the star.

11. The display mechanism according to claim 9, wherein each said planet wheel set is mounted to pivot freely on an arm or a periphery of said star.

12. The display mechanism according to claim 9, wherein each said planet wheel is mounted to pivot with friction in a housing comprised in an arm or a periphery of said star.

13. The display mechanism according to claim 9, wherein each said planet wheel set is mounted at an end of an arm which is flexible and comprised in said star.

14. The display mechanism according to claim 1, wherein said display mechanism is a moon phase or moon age display.

15. The display mechanism according to claim 1, wherein said display mechanism is a day/night display.

16. The display mechanism according to claim 1, wherein said display mechanism is an AM/PM display.

17. The display mechanism according to claim 1, wherein said display mechanism is a universal time display.

18. The display mechanism according to claim 1, wherein said display mechanism is a calendar, date, day, or month, or leap year display.

19. A timepiece comprising a timepiece movement arranged to drive at least one display mechanism according to claim 1, wherein said display mechanism comprises a separate function for driving said control wheel set in a back-and-forth pivoting movement with a limited angular travel, and for a continuous pivoting in a single direction of a star carrying each said planet wheel set.

20. The timepiece according to claim 19, wherein said timepiece is a watch.

* * * * *